United States Patent [19]

Rinaldi

[11] Patent Number: 4,576,372

[45] Date of Patent: Mar. 18, 1986

[54] TURNTABLE EXERCISE MACHINE

[76] Inventor: Michael Rinaldi, 193 Norwood Ave., Lodi, N.J. 07644

[21] Appl. No.: 676,489

[22] Filed: Nov. 29, 1984

[51] Int. Cl.[4] ..... A63B 23/04

[52] U.S. Cl. ..... 272/146; 108/142; 272/130; 272/131

[58] Field of Search ..... 272/146, 69, 73; 108/142; 248/664

[56] References Cited

U.S. PATENT DOCUMENTS

| | | | |
|---|---|---|---|
| 3,100,639 | 8/1963 | Bonewitz | 272/146 |
| 3,784,193 | 1/1974 | Simjian | 272/146 |
| 4,305,579 | 12/1981 | Rice | 272/146 |
| 4,505,476 | 3/1985 | Rubin | 272/146 |

*Primary Examiner*—Richard J. Apley
*Assistant Examiner*—John Welsh
*Attorney, Agent, or Firm*—Stephen E. Feldman

[57] ABSTRACT

A cylindrical body houses a disc-like pressure plate between a bottom of the body and a disc-like top plate. Ball bearing races are disposed between the body and pressure plate and between the pressure plate and top plate. A reversable ratchet mechanism interconnects the top plate and pressure plate for either conjoint rotation in one rotative direction or conjoint rotation in the opposite rotative direction; while permitting rotation of the top plate without the pressure plate in the opposite direction. A setting lever is provided to change the direction of conjoint rotation of the top plate and pressure plate. The ratchet mechanism includes a drive spur having teeth which coact with a ring gear formed in an opening in the upper surface of the pressure plate. An inflattable bladder is disposed between the body and the periphery of the pressure plate to selectively modify the force required to rotate the pressure plate conjointly with the top plate. An opening is formed in the top plate for selective receipt of a handle to facilitate certain exercise; while a retractable stabilizing slide is also provided for the housing to facilitate certain exercises. Rubber or other soft, high friction, material may be applied over the surface of the top plate and bottom surface of the body to facilitate positioning of the machine and use thereof.

13 Claims, 7 Drawing Figures

FIG. 1
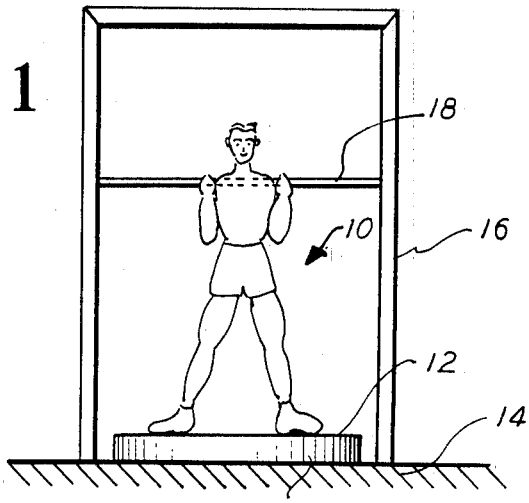
FIG. 3
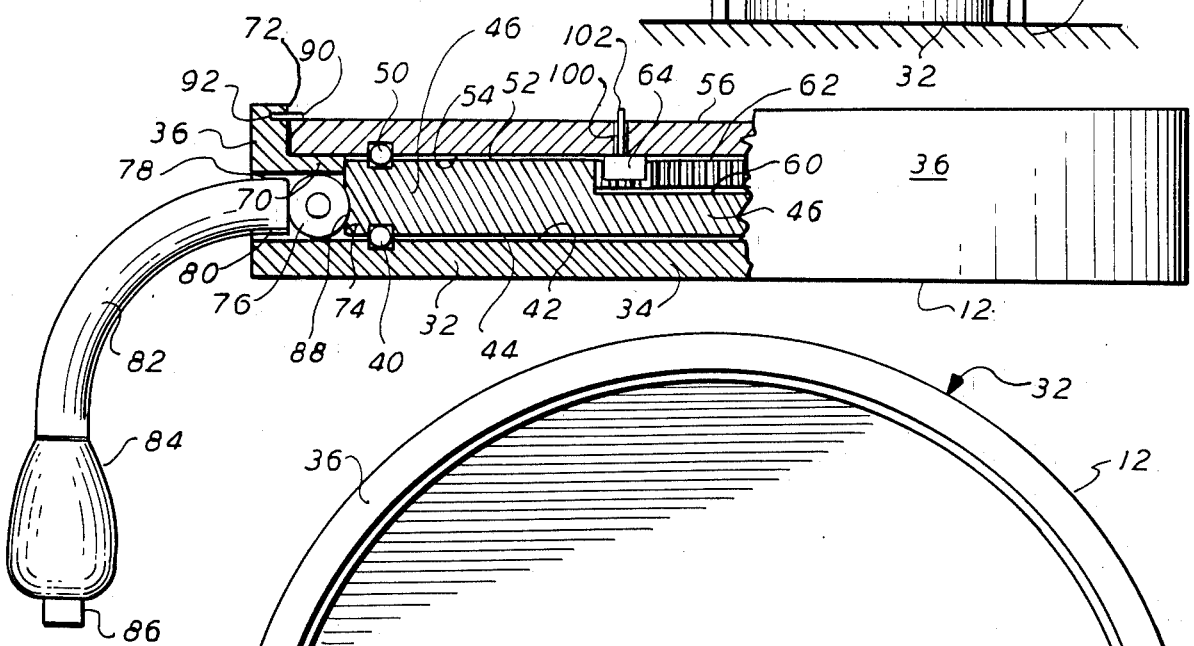
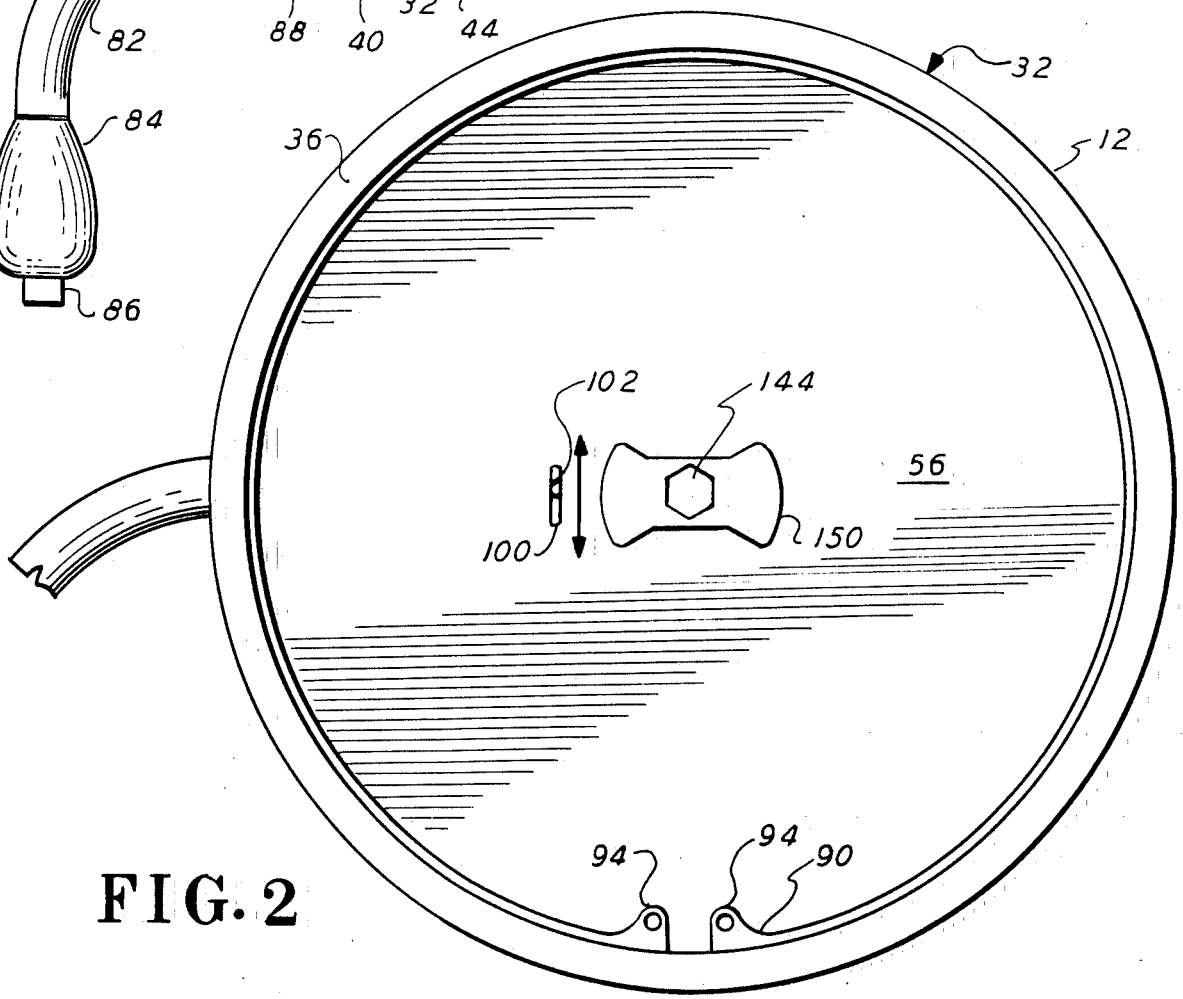
FIG. 2

TURNTABLE EXERCISE MACHINE

BACKGROUND OF THE INVENTION—FIELD OF APPLICATION

This invention relates to exercise equipment and devices; and more particularly to turntable-type exercise equipment and machines.

BACKGROUND OF THE INVENTION—DESCRIPTION OF THE PRIOR ART

Physical fitness and good health are important to many people. To attain these ends a significant number of persons exercise on a regular basis. Some exercise routines are accomplished without the aid or use of devices, equipment and machines; while other exercise routines require and can only be done with the aid of exercise equipment and machines.

Thus, there are many types and routines of exercise, depending upon what muscles or other body attribute is to be exercised. Accordingly, there are many types and constructions of exercise equipment, devices and machines. Some such equipment is contructed to be general in application and use; while other exercise machines are constructed to facilitate a specific type of exercise routine.

Some exercise routines are accomplished by requiring the person to execute a twisting motion of the body. To facilitate this type of exercise routine a turntable-type exerciser may at times be used. Turntable-type exercise devices such as those shown in U.S. Pat. No. 3,454,273 issued on July 8, 1969 to E. M. Vogt for *Exercise Device Of The Twist Board Type,* and in U.S. Pat. No. 3,593,994 issued on July 20, 1971 to A. I. Ahbar for *Pirovette Exercise Device,* however merely provide a turntable rotatable upon a base with no means to vary the degree of effort of the exercise routine.

On the other hand, turntable exercise machines such as those shown in U.S. Pat. No. 3,100,639 issued on Aug. 13, 1963 to E. D. Bonewitz for *Exerciser,* and U.S. Pat. No. 4,305,579 issued on Dec. 15, 1981 to M. Rice for *Exercising Device,* utilize weights which are selectively added or removed to provide a means to vary the exercise effort. But the disposition of the weights on the turntable surface limit the turntable surface space available to be utilized to assume different stances; possibly rendering such devices somewhat undesirable. Also resistance is overcoming inertia only; so it is only applied at the extremes of the movement overcoming the momentum built up in the other direction. This does not provide a work load for the muscles which is constant through the entire range of motion.

Exercise machines such as those shown on U.S. Pat. No. 4,391,441 issued on July 5, 1983 to L. G. Simjian for *Exercise Apparatus,* and in U.S. Pat. No. 4,313,603 issued on Feb. 3, 1982 to L. G. Simjian for *Exercise Apparatus,* are designed and constructed to exercise both the body and the arms with one constrained to move with respect to the other in the designated use of the machines. The extra added mechanism for effecting exercise of the arms adds to the overall cost of the equipment and may place restrictions on possible use of the equipment for body exercise only. As such, the equipment could prove undesirable to those desiring only body exercise machines.

Alternatively, exercise machines of the type shown in U.S. Pat. No. 3,784,193 issued on Jan. 8, 1974 to L. G. Simjian for *Friction Type Exercising Device With Separate Handgrip Exerciser,* not only provides for body twist type exercises and coordinated arm exercises but also provides for hand exercising as well. The inclusion of relatively complex mechanisms to facilitate all these coordinated exercises adds to the cost and complexity of the machines and most probably detracts from its usefullness to one only desiring to accomplish body twist type exercises. Such devices may also detract from the intensity of concentration to one area at a time which is an important body building principle. Although the machine includes means to selectively vary the twisting force required to rotate the turntable such means is applied only at a selected area and may thus be subject to undue wear, and provide uneven forces which may be detrimental to the desired exercise routines.

SUMMARY OF THE INVENTION

It is therefore an object of this invention to provide a new and improved exercise machine.

It is another object of this invention to provide a new and improvied machine for facilitating twisting motion type exercises.

It is yet another object of this invention to provide a new and improved turntable type exercise machine.

It is still another object of this invention to provide a new and improved turntable type exercise machine which offers progressive resistance, isokinetic resistance and high intensity exercise of the muscles governing twisting motions of the body.

It is yet still another object of this invention to provide a new and improved turntable type exercise machine which facilitates rotation of the turntable in a selected direction while requiring the exertion of greater effort to effect rotation of the turntable in the opposite direction.

It is yet still another object of this invention to provide a new and improved turntable exercise machine for high intensity work, and which does not give the muscle being worked a time to rest.

It is a further object of this invention to provide a new and improved turntable-type exercise machine which may be selectively adjusted to require a selected force to effect rotation of the turntable.

It is yet a further object of this invention to provide a new and improved turntable type exercise machine which provides a means of resistance for exercising muscles around hinge and ball and socket joints, in postures and movements similar to/or identical to Nautilus arm machine, pullover chest, hip and back, leg extension, leg curl, pectoral machine, and the like. It is yet still a further object of this invention to provide a new and improved turntable-type exercise machine which may be selectively adjusted to apply a given restraint evenly around the turntable and thus require a selected force to effect rotation of the turntable.

The invention accordingly consists in the features of construction, combination of elements, and arrangement of parts which will be exemplified in the system, device, and article of manufacture hereinafter described, and of which the scope of application is as elucidated, supra, as will be indicated in the appended claims. In this regard, numerous alternatives within the scope of the present invention besides those alternatives, preferred embodiments or modes of practicing the invention supra, and those to be elucidated, infra, will occur to those skilled in the art.

BRIEF DESCRIPTION OF THE DRAWING

In the drawing:

FIG. 1 is a schematic illustration of a person performing exercises on a turntable exercise machine incorporating the instant invention;

FIG. 2 is a plan view of the exercise machine of FIG. 1 on a scale larger than that of FIG. 1;

FIG. 3 is an elevational view of the exercise machine of FIG. 2, in partial section to better shown details thereof;

DESCRIPTION OF THE PREFERRED EMBODIMENT

Figure 4:
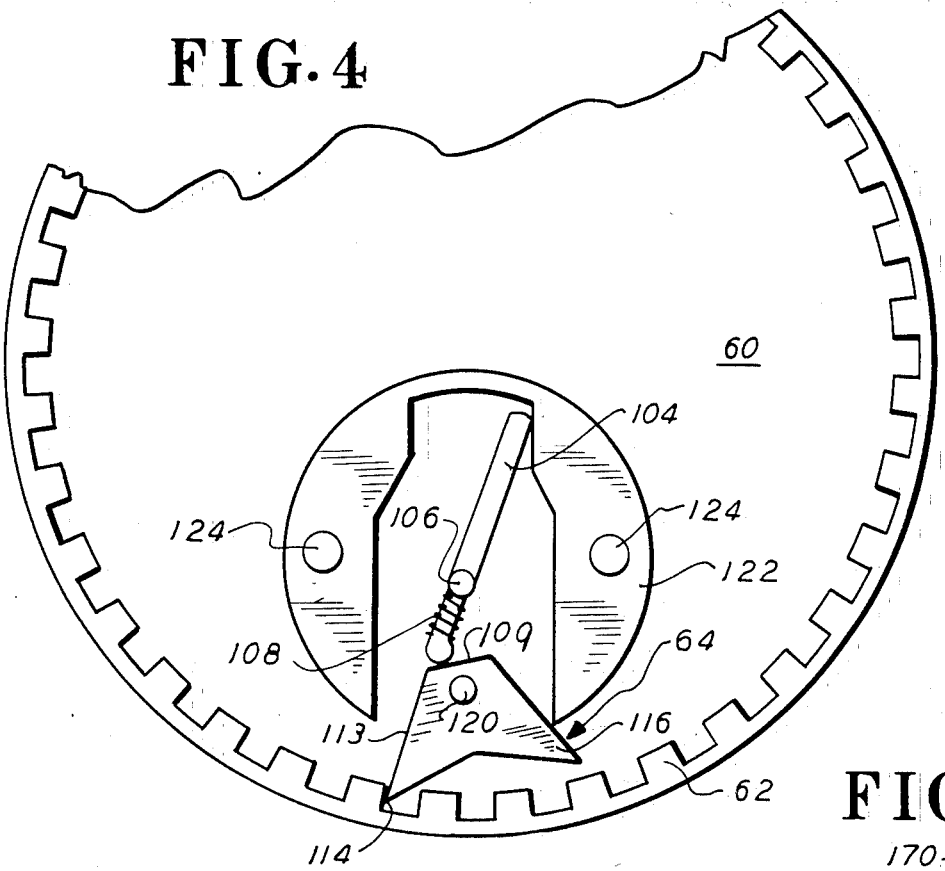
FIG. 4 is a plan view of the exercise machine of FIGS. 2 and 3 with its top plate and other parts removed to better show details of the ratchet mechanism.

With reference to FIG. 1, there is generally shown at 10 a person positioned upon a turntable-type exercise machine 12 incorporating the instant invention. Machine 12 is disposed on a floor 14 in a doorway 16 where person 10 is performing body twisting motion exercise routines with the aid of an exercise bar 18 suitably disposed and secured in doorway 16.

Machine 12 (FIGS. 2 and 3) is fabricated from suitable materials such as wood, steel, aluminum, plastic or the like, individually or in combination, and includes a body portion 32. Body portion 32 is fabricated as a cylinder closed at its bottom and opened at the top and incudes a bottom wall 34 and a cylindrical side wall 36 formed integral therewith and rising therefrom.

A bearing race 40 (FIG. 3) is formed between an upper surface 42 of bottom wall 34 and a lower surface 44 of a pressure place 46 disposed within body portion 32. Pressure plate 46 is formed of suitable material and in the configuration of a cylindrical disc (FIG. 3). A bearing race 50 is formed, in a manner similar to bearing race 40, but between an upper surface 52 of pressure plate 46 and a lower surface 54 of a top plate 56. A centrally disposed circular opening 60, formed in upper surface 52 of pressure plate 46, has a 360° circle of ring gear teeth 62 (FIGS. 3 and 4) formed in the surface thereof for coaction with a ratchet mechanism 64 carried by top plate 56.

A shoulder 70 extends inward from an inner surface 72 of side wall 36 to facilitate spacing pressure plate 46 therefrom and to form a circular channel 74 within which is disposed an inflatable bladder 76. An opening 78 extends through side wall 36 to receive a "T" fitting assembly 80 connecting a hose 82 to bladder 76. Hose 82 extends from bladder 76 and terminates at an inflation bulb 84. A release valve 86 is provided for bulb 84 in a conventional manner. A peripheral wall 88 of pressure plate 46 may be formed either with a cylindrical surface, or if preferred with a concavity for better coaction with the outer surface of bladder 76 as it is inflated and/or deflated.

A circumferential lock ring 90, received in a circular groove 92 formed in inner surface 72 of side wall 36, serves to secure top plate 56 in position while permitting rotation thereof for exercise purposes. A pair of compression tabs 94 (FIGS. 2) are provided on lock ring 90 to facilitate removal and insertion thereof.

An elongated slot 100 (FIGS. 2 and 3) extends through top plate 56. A reversing lever 102 has one of its ends extending up through slot 100 and its other end connected to a direction lever 104 (FIG. 4) of ratchet mechanism 64. A pivot pin 106 serves to mount and facilitate the movement of direction lever 104; while a spring loaded keeper 108 is disposed between an end of direction lever 104 and an end wall 109 of a drive spur 113 formed with a pair of spaced ratchet teeth 114, 116 disposed and constructed to coact with ring gear teeth 62. A pivot pin 120 mounts drive spur to lower surface 54 of top plate 56. A housing 122, for ratchet mechanism 64, is secured to lower surface 54 of top plate 56 by a pair of mounting pins 124.

Turntable exercise machine 12 is designed and constructed to offer progressive resistance, isokinetic resistance and high intensity exercise of the muscle governing twisting motions of the body. Many such exercises are possible. For example, machine 12 may be disposed in a doorway 16 (FIG. 1) with an exercise bar 18 positioned and secured therewithin either at shoulder height or at other selected positions. The user assumes a proper stance on top plate 56 of machine 12 and properly supports their shoulders by utilizing bar 18. They then twist as far as possible to either side.

When so twisting, top plate 56 will rotate upon bearing race 50; the direction depending upon the setting of direction lever 104. If lever 104 is set as shown in FIG. 4 clockwise rotation of top plate 56 will also drive pressure plate 46 in the clockwise direction due to the coaction of tooth 114 of drive spur 113 and teeth 62. Upon rotation of top plate 56 in the reverse direction, tooth 114 will ratchet over teeth 62.

The effort requied to rotate top plate 56 and pressure plate 46 may be selectively controlled by inflating bladder 76 through the use of bulb 84; or by deflating bladder 76 by using release valve 86 to release air from bladder 76. The more bladder 76 is inflated the more pressure it will assert on the periphery of pressure plate 46. The greater the pressure of bladder 76 on plate 46 the greater the effort will be required to rotate top plate 56 when coupled to pressure plate 46 by ratchet mechanism 62. Movement of reversing lever 102 and direction lever 104 rocks the position of drive spur 113 so that tooth 116 thereof coacts with teeth 62. When this is accomplished rotation of top plate 56 in the counterclockwise direction carries pressure plate 46 with it for exercise effort purposes; while return rotation of top plate 56 (in the clockwise direction) occurs without a corresponding rotation of pressure plate 46.

An alternative exercise would be accomplished as above but standing on either one or the other foot. Still other exercises could be performed as above but with bar 18 held in front and/or overhead.

Figure 5:
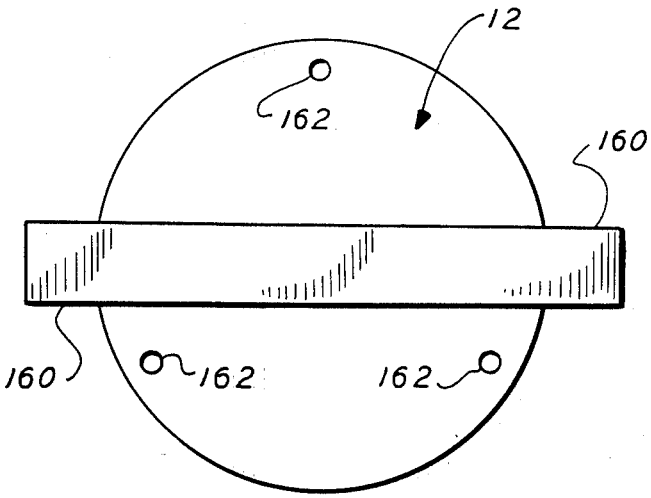
FIG. 5 is a bottom view of the exercise machine of FIGS. 2–4 modified to facilitate particular type exercises.
Figure 6:
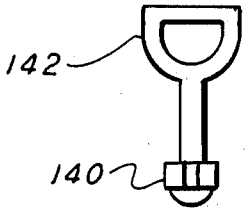
FIG. 6 is a schematic isometric showing of an accessory key usable with the exercise machine of FIGS. 2–4 for particular types of exercise.

Additional exercises may be accomplished by inserting the hexagonal end 140 (FIG. 6) of a handle 142 in a hexagonal opening 144 formed in the top surface of top plate 56. For convenience a "universal foot print" 150 may be provided on the top surface of top plate 56. Such "universal foot print" 150 is utilized to facilitate the exercises done on one foot. When handle 142 is inserted in opening 144 twisting exercises to either side may be accomplished by holding handle 142 with one hand. To facilitate such exercises a retractable slide 160 (FIG. 5) may be provided to stabilize machine 12.

Holes 162 (FIG. 5) may be provided in body 32 to facilitate securing machine 12 in a desired position. Alternative means may be provided to so secure machine 12. Additionally, rubber or other soft, high friction, material may be applied over the upper surface of top plate 56 to facilitate standing thereon, and to the bottom surface of body 32 to facilitate positioning of machine 12.

Still other exercises may be accomplished by holding bar 18 with a single hand and twisting the body.

Figure 7:
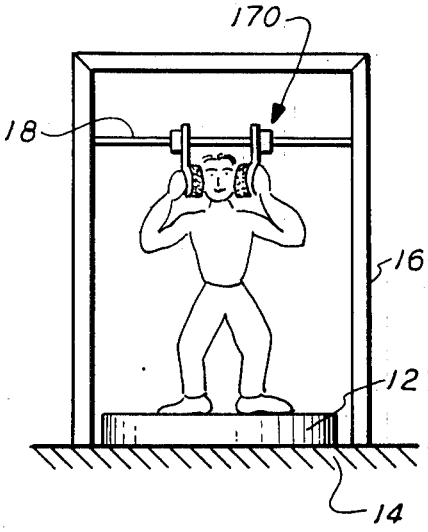
FIG. 7 is a schematic illustration of a person performing still other exercise routines with the exercise machine of FIGS. 2–4.

Further exercise routines may be accomplished by stabilizing the head with a restraint device of conventional construction such as head restraint 170 (FIG. 7) mounted by conventional means to bar 18.

Exercises utilizing machine 12 are applicable to power movements in many types of sports. They may be utilized for preventive and rehabilitative therapy for injuries to ankles, knees, hips, back, neck, shoulders, elbow, and wrist. Such exercise will help to develop strength in twisting movements of all these joints.

With the described machine adjustable, progressive resistance, and very high resistance power training is possible. There is an ability to exercise in one direction (clockwise or counterclockwise) at a time for high intensity training of specific muscle groups.

As various possible embodiments might be made of the above invention, and as various changes might be made in the embodiments above set forth, it is to be understood that all matter herein described or shown in the accompanying drawings is to be interpreted as illustrative and not in a limiting sense. Thus, it will be understood by those skilled in the art that although preferred and alternative embodiments have been shown and described in accordance with the Patent Statutes, the invention is not limited thereto or thereby, since the embodiments of the invention particularly disclosed and described herein above are presented merely as an example of the invention. Other embodiments, forms, and modifications of the invention, coming within the proper scope and spirit of the appended claims, will of course readily suggest themselves to those skilled in the art. Thus, while there has been described what is at present considered to be the preferred embodiments of the invention, it will be obvious to those skilled in the art that various changes and modifications may be made therein, without departing from the invention, and it is, therefore aimed in the appended claims to cover all such changes and modifications as fall within the true spirit and scope of the invention, and it is understood that, although I have shown the preferred form of my invention, that various modifications may be made in the details thereof, without departing from the spirit as comprehended by the following claims.

What is claimed is

1. A turntable exercise machine; comprising:

(a) machine body means;

(b) pressure plate means rotatively carried by said machine body means;

(c) top plate means rotatively carried by said pressure plate means; and (d) ratchet means disposed between said pressure plate means and said top plate means and coacting with said pressure plate means and top plate means to effect concurrent rotation of said top plate means and said pressure plate means upon rotation of said top plate means in a first predetermined direction, and rotation of said top plate means and not said pressure plate means upon rotation of said top plate means in a second predetermined direction.

2. The turntable exercise machine of claim 1, wherein said first predetermined direction is clockwise and said second predetermined direction is counterclockwise.

3. The turntable exercise machine of claim 1, including inflatable bladder means disposed for coaction with said pressure plate means, and selectively actuable means to selectively inflate and deflate said bladder means; said inflattable bladder means coacting with said pressure plate means to vary the resistance thereof to rotation.

4. The turntable exercise machine of claim 3, wherin said selectively actuable means includes bulb means for inflating said bladder means and relief valve means to release air from said bladder means.

5. The turntable exercise means of claim 4, wherein said pressure plate means is in the form of a disc with a substantially circular circumference, and said inflattable bladder means surrounds and coacts with said circular circumference of said pressure plate means.

6. The turntable exercise machine of claim 5, wherein said machine body includes internally disposed shoulder means forming a channel within which said inflattable bladder means is received and disposed for coaction with said pressure plate means.

7. The turntable exercise machine of claim 1, wherein said ratchet means is selectively settable between a first condition wherein said top plate means and pressure plate means rotate together in said first predetermined direction, and a second condition wherein said top plate means and pressure plate means rotate together in said second predetermined direction; and settable lever means selectively settable and coacting with said ratchet means to move same between said first condition and said second condition.

8. The turntable exercise machine of claim 7, wherein said ratchet means includes a positionable drive spur and said pressure plate means includes an internally formed ring gear.

9. The turntable exercise machine of claim 8, wherein said ring gear is formed in an opening centrally formed in said pressure plate means and said ratchet means is carried by said top plate means for coaction with said ring gear.

10. The turntable exercise machine of claim 1, wherein ball bearing type race means are disposed between said top plate means and said pressure plate means and between said pressure plate means and said machine body means.

11. The turntable exercise machine of claim 1, including opening means of predetermined configuration formed in an upper surface of said top plate means, and handle means including an end formed to said predetermined configuration for selective insertion into and withdrawal from said opening means.

12. The turntable exercise machine of claim 11 wherein said predetermined configuration of said opening means and said end of said handle means is hexagonal.

13. The turntable exercise machine of claim 12 including slide means carried by said body means for selective extension therefrom to stabilize the exercise machine for selected exercise routines, and retractable with respect thereto when not so required.

* * * * *